United States Patent [19]

Okamoto

[11] Patent Number: 4,847,595

[45] Date of Patent: Jul. 11, 1989

[54] ALARM SYSTEM

[75] Inventor: Hiromichi Okamoto, Hamamatsu, Japan

[73] Assignee: Atsumi Denki Kabushiki Kaisha, Hamamatsu, Japan

[21] Appl. No.: 123,248

[22] Filed: Nov. 20, 1987

[30] Foreign Application Priority Data

Dec. 8, 1986 [JP] Japan ..... 61-290475

[51] Int. Cl.[4] ..... G08B 13/00; G08B 26/00; G08B 29/00

[52] U.S. Cl. ..... 340/541; 340/505; 340/506; 340/533

[58] Field of Search ..... 340/541, 693, 538, 533, 340/534, 505, 825.54, 506, 825.16, 825.64, 825.63, 825.44

[56] References Cited

U.S. PATENT DOCUMENTS 4,446,458 5/1984 Cook ..... 340/538 X 4,477,800 10/1984 O'Brien ..... 340/533

*Primary Examiner*—Glen R. Swann, III

*Assistant Examiner*—Thomas J. Mullen, Jr.

*Attorney, Agent, or Firm*—Spencer & Frank

[57] ABSTRACT

An intrusion alarm system includes a single transmission line composed of two wires to which a controller and a plurality of detectors are connected. The transmission line transmits electric power as well as detection signals. The controller includes a code transmitter which modulates codes assigned to the respective detectors by using a predetermined carrier wave and transmits them successively with a predetermined time interval, a receiver which receives output signals from the detectors, a display for output signals from the receiver, and a DC power source which is common to the detectors and connected to the line. Each of the detectors includes an intrusion sensing part for detecting intrusion at a place where the detector is disposed, a code detector circuit which demodulates the signals from the controller and detects the assigned code for the detector in question, and a transmitter circuit which modulates an output signal from the intrusion sensing part by using a carrier wave having the same frequency as the carrier wave for the selected code transmitter and transmits it to the transmission line.

10 Claims, 3 Drawing Sheets

ALARM SYSTEM

BACKGROUND OF THE INVENTION

This invention relates to an alarm system for detecting intruders in buildings, houses, factories, etc. and generating an alarm in response to the intrusion detection.

The intruder detection systems used so far include the infrared beam transmitter/receiver which produces an alarm signal when the beam is interrupted and the infrared detector which produces an alarm signal upon detection of an infrared radiation from an intruder. Examples of the conventional alarm systems of the latter type are disclosed in U.S. Pat. Nos. 3,760,399; 3,928,843; 3,703,718; etc. In either type of system, in order to cover the whole building or whole area to be guarded, such detection systems connected to the controller by their own lines are located along the possible invasion paths.

Such distributed alarm systems require, besides a large number of signal lines, a power line to feed electric power to each detector. Therefore, installation is very expensive and sometimes spoils the appearance of buildings.

It is an objective of the present invention to provide an alarm system which has a simplified wiring and installation compared to the aforementioned prior art devices.

SUMMARY OF THE INVENTION

The present invention comprises a transmission line composed of two wires having a certain characteristic impedance and detectors connected to the line at therealong appropriate positions therealong. The line is used for supplying electric power to each detector. The system further includes a controller which modulates the carrier wave of a predetermined frequency by a code assigned to each detector and sends the modulated signal through the transmission line to each at every specified time interval. Upon receiving the modulated signal, each detector demodulates it to detect the code. If the code thus detected coincides with the assigned one, then the detector modulates the carrier wave by information including the presence of an intruder and sends the modulated signal to the controller through the transmission line. The controller detects the present state of each detector by demodulating the modulated signal.

Accordingly, in the present system, one transmission line is available both for sending information of each detector in time-divided fashion and for supplying electric power to each detector.

Thus, the present system has the advantages that the wiring between the controller and the distributed detectors can easily be carried out and that the building appearance is not marred by the wiring. In addition, many kinds of information, such as the presence of an intruder and malfunction of the detector, can readily be transmitted to the controller, in the form of code.

DETAILED EXPLANATION OF THE PREFERRED EMBODIMENT

Figure 1:
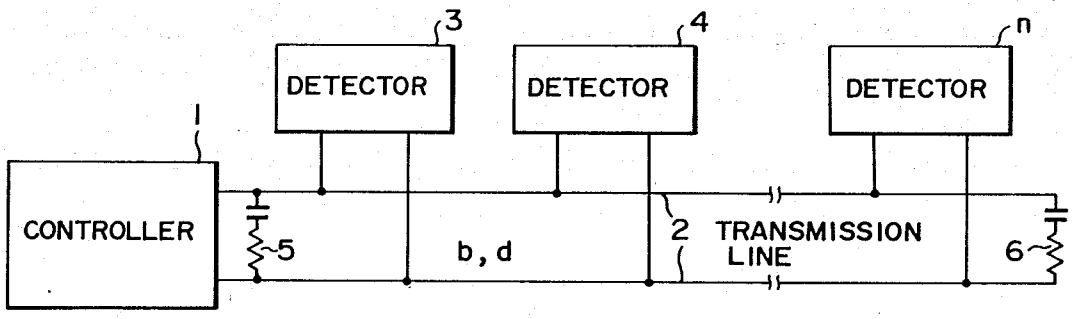
FIG. 1 is a block diagram of an embodiment of an alarm system according to the present inention.

Referring to FIG. 1 showing an embodiment of an alarm system according to the present invention, an alarm system includes a controller 1 and a transmission line 2 composed of two wires, one end of the transmission line 2 being connected to an output terminal of the controller 1. The system further includes a number of detectors 3, 4 ... n connected to the line at appropriate positions therealong. Both ends of the transmission line 2 are terminated by CR series circuits 5, 6 having the characteristic impedance of the line to prevent the reflection of signals.

Figure 2:
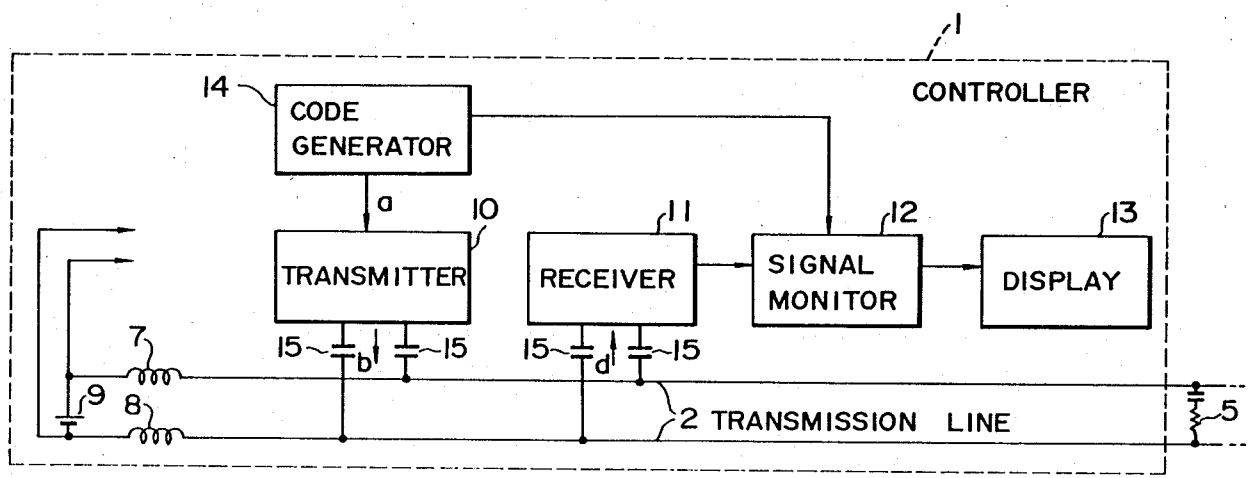
FIG. 2 is a block diagram of the controller shown in FIG. 1.

Referring next to FIG. 2 showing the controller 1, a DC power source 9 is connected to the transmission line 2 through coils 7, 8 for blocking high frequencies. The power source 9 is further connected to a code transmitter 10, a receiver 11, a signal monitor 12, a display 13 and a code generator 14. The output terminal of the receiver 11 is connected to the transmission line 2 through coupling capacitors 15.

Figure 3:
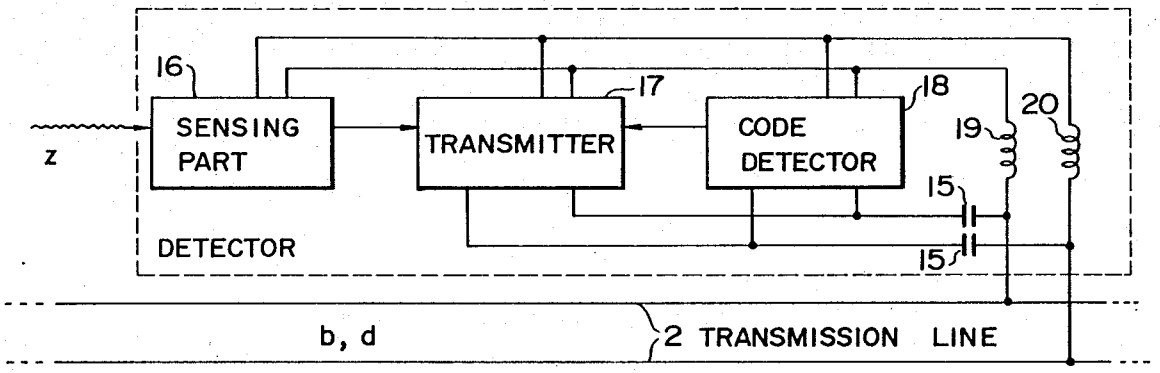
FIG. 3 is a block diagram of one of the detectors shown in FIG. 1.

Referring next to FIG. 3 showing one of the detectors 3, 4, ..., n, the detector includes an intrusion sensing part or portion 16, a transmitter 17 and a code detector 18. The power supply terminals of these circuits are connected to the transmission line 2 through coils 19, 20 for blocking high frequencies. The output terminal of the transmitter 17 and the input terminal of the detector 18 are connected to the transmission line 2.

Operation of the aforementioned alarm system will now be described. The DC power source 9 in the controller 1 supplies electric power to the detectors 3, 4, ..., n, through the transmission line 2 as well as to the controller 1 itself. The code generator 14 of the controller 1 generates a series of binary codes p, q, n, ... (see a of FIG. 4) which are assigned to the respective detectors 3, 4, ... n, and sends them to the transmitter 10, which modulates a high frequency carrier wave by the codes (see b of FIG. 4) and sends the modulated signal to the transmission line 2 through the coupling capacitors 15, 15.

The sensing part 16 in each of the detectors 3, 4, ... n, supplies a predetermined signal to the transmitter circuit 17 simultaneously with intrusion detection, for example, when an infrared beam z is interrupted by an intruder, or infrared radiation from an intruder's body is detected. Furthermore, a different output signal of another type may be given, if required, when other trouble states are detected, for example, the case of malfunction such as the case when the infrared beam level has been lowered for a long time. On the other hand, the code detector 18 always demodulates the high frequency signals transmitted from the controller 1 to the line 2.

When the demodulated signal coincides with the code assigned to the detector involved, an output signal c (see c of FIG. 4) is transmitted from the code detector 18 to the transmitter 17 of a time delay U and a predetermined signal width. Upon receiving the signal, the transmitter 17 modulates a carrier wave of a predetermined frequency by the code sent from the sensing part 16, and transmits it to the line 2 through the coupling capacitors 15, 15. Therefore, the line 2 receives high frequency signals as shown in d of FIG. 4 from the detectors 3, 4, ... n with every constant time interval. Each of the signals is inserted between the high frequency signals shown in b of FIG. 4.

Figure 4:
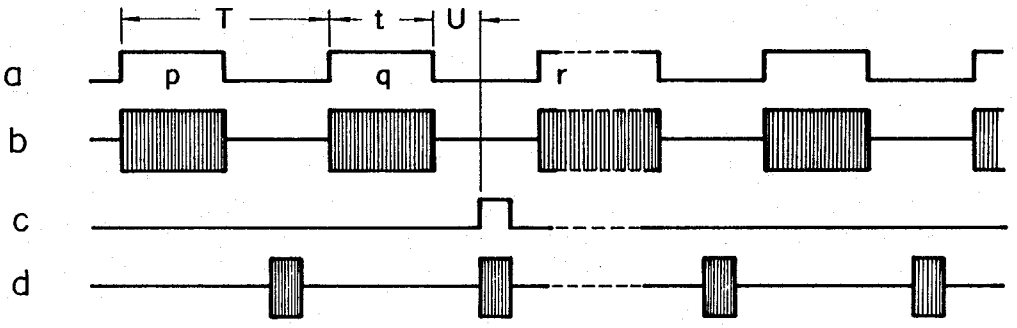
FIG. 4 is a waveform diagram of the system shown in FIG. 1.

The receiver 11 in the controller 1 shown in FIG. 2 demodulates the signals shown in d of FIG. 4 and transmits the demodulated code to the signal monitor 12. On the other hand, the code generator 14 transmits a signal, which corresponds to the code q just before the signal c, to the signal monitor 12. Therefore, the signal monitor 12 detects these signals and transmits a corresponding signal to the display 13. The display 13 indicates information sent from each detector.

Figure 5:
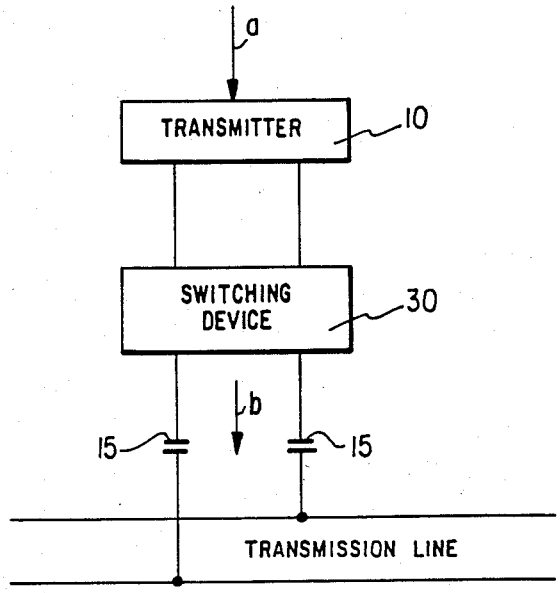
FIG. 5 is a block diagram of an embodiment wherein a transmitter of the controller is connected to a switching device.
Figure 6:
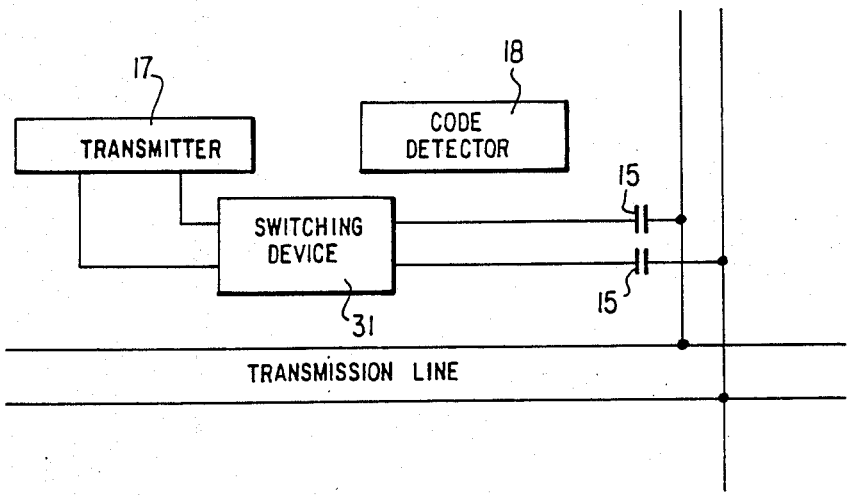
FIG. 6 is a block diagram of an embodiment wherein a transmitter of each detector is connected to a switching device.

If required as shown in FIG. 5, a switching device 30 can be connected to the output terminal of the transmitter 10 in the controller 1 As shown in FIG. 6, a switching device 31 can be connected to the output terminal of the transmitter 17 in each of the detectors 3, 4, ..., n. The switching devices 30 and 31 are closed only when the transmitter circuit 17 or the transmitter 10, respectively, transmits an output signal, in order to reduce the line impedance.

As can be seen from the above explanation in connection with the preferred embodiment, the alarm system according to the present invention uses a single power line which can also transmit the signals detected by the detectors, so that the wiring is greatly simplified compared to prior art device, and the building appearance is not marred.

While the invention has been particularly shown and described with reference to the preferred embodiment thereof, it will be understood by those skilled in the art that the foregoing and other changes in form and details can be made without deparating from the spirit and scope of the invention.

What is claimed is:

1. An alarm system comprising:

a controller;

a transmission line having one end connected to said controller; and a plurality of detectors connected to said transmission line at a plurality of respective positions therealong;

said controller including a code transmitter which modulates codes assigned to respective ones of said plurality of detectors by using a predetermined carrier wave and transmits the modulated codes successively with a predetermined time interval, a receiver which receives output signals from said detectors, a display means for displaying output signals from said receiver and a DC power source which is common to said plurality of detectors and connected to said transmission line; and each of said plurality of detectors including an intrusion sensing means for detecting intrusion where the respective one of said detectors is disposed, a code detector circuit which demodulates said modulated codes from said controller and detects the assigned code for the respective one of said detectors, and a transmitter circuit which modulates an output signal from said intrusion sensing means by using a carrier wave having the same frequency as said predetermined carrier wave for said code transmitter and transmits the modulated output signal to said transmission line.

2. An alarm system according to claim 1, wherein at both ends of said transmission line are connected CR series circuits having the same characteristic impedance as said line.

3. An alarm system according to claim 1, wherein said DC power source is connected to said transmission line through coils for blocking high frequencies.

4. An alarm system according to claim 1, wherein power terminals of said intrusion sensing means, said transmitter circuit and said code detector circuit are connected to said transmission line through coils for blocking high frequencies.

5. An alarm system according to claim 1, wherein an output terminal of said transmitter circuit and an input terminal of said code detector circuit are connected to said transmission line through coupling capacitors.

6. An alarm system according to claim 1, wherein an output signal from said code transmitter includes a series of binary codes with a predetermined time interval and a predetermined code width.

7. An alarm system according to claim 1, wherein an output terminal of said code transmitter and an input terminal of said receiver are connected to said transmission line through coupling capacitors.

8. An alarm system according to claim 1, wherein an output signal from the respective said intrusion sensing means of each of said plurality of detectors indicates whether there is any intrusion as well as whether there is any malfunction of the respective one of said detectors.

9. An alarm system according to claim 1, wherein an output terminal of said transmitter circuit of each of said detectors and an output terminal of said code transmitter in said controller are respectively provided with switching devices which are closed only when said transmitter circuit or said code transmitter transmits an output signal.

10. An alarm system according to claim 1, wherein output signals from respective ones of said plurality of detectors are consecutively inserted between output signals from said code transmitter in said line.

* * * * *